US005855434A

United States Patent [19]

Hagen

[11] Patent Number: 5,855,434

[45] Date of Patent: Jan. 5, 1999

[54] PACKAGE RECLOSURE LABEL AND PACKAGE

[75] Inventor: Ronald G. Hagen, Larsen, Wis.

[73] Assignee: Menasha Corp., Neenah, Wis.

[21] Appl. No.: 779,871

[22] Filed: Jan. 6, 1997

[51] Int. Cl.[6] ..... B65D 33/18

[52] U.S. Cl. ..... 383/89; 383/62; 383/82; 383/203

[58] Field of Search ..... 383/62, 71, 72, 383/81, 82, 89, 11, 203

[56] References Cited

U.S. PATENT DOCUMENTS

| | | | |
|---|---|---|---|
| 1,681,769 | 8/1928 | Heston . | |
| 2,098,164 | 11/1937 | Rice . | |
| 2,153,310 | 4/1939 | Newman . | |
| 3,946,507 | 3/1976 | Fergg et al. . | |
| 4,008,851 | 2/1977 | Hirsch | 383/71 X |
| 4,479,838 | 10/1984 | Dunsirn et al. . | |
| 4,526,405 | 7/1985 | Hattemer . | |
| 4,543,139 | 9/1985 | Freedman et al. . | |
| 4,584,201 | 4/1986 | Boston . | |
| 4,622,799 | 11/1986 | Boston . | |
| 4,679,693 | 7/1987 | Forman . | |
| 4,840,270 | 6/1989 | Caputo et al. . | |
| 4,902,141 | 2/1990 | Linnewiel . | |
| 4,911,563 | 3/1990 | Ciani | 383/89 |
| 4,966,780 | 10/1990 | Hargraves et al. . | |
| 4,982,845 | 1/1991 | Prascak et al. . | |
| 5,029,712 | 7/1991 | O'Brien et al. . | |
| 5,035,518 | 7/1991 | McClintock . | |
| 5,125,211 | 6/1992 | O'Brien et al. . | |
| 5,154,293 | 10/1992 | Gould . | |
| 5,161,687 | 11/1992 | Kornell et al. . | |
| 5,366,087 | 11/1994 | Bane . | |
| 5,387,453 | 2/1995 | Cummisford . | |
| 5,399,403 | 3/1995 | Instance . | |
| 5,511,883 | 4/1996 | Clark et al. | 383/82 X |
| 5,582,889 | 12/1996 | Pedrini | 383/62 X |

FOREIGN PATENT DOCUMENTS

| | | | |
|---|---|---|---|
| 517566 | 12/1992 | European Pat. Off. | 383/89 |
| 2173770 | 10/1986 | United Kingdom | 383/71 |
| 2248052 | 3/1992 | United Kingdom | 383/62 |

OTHER PUBLICATIONS

Applicants' Exhibit A: PAK–SEAL™ RE SEAL brochure (4 pages) and label samples (2). Undated, admited prior art.

*Primary Examiner*—Jes F. Pascua
*Attorney, Agent, or Firm*—Quarles & Brady

[57] ABSTRACT

A package reclosure label has a paper base label which is secured by a pressure-sensitive adhesive to the package. A tear resistant synthetic top sheet has a first end permanently adhered to the base sheet and extends beyond the far end of the base sheet to a second end which is secured by a resealable adhesive directly to the package. A generally unadhered central portion of the top sheet is also releasably adhered to the base sheet. The package is reclosed by folding over its open flap and adhering the first end of the top sheet to the flap. The labels are provided for application to packages side-by-side in multitude on a continuous release liner, with the pressure sensitive adhesive of the base sheet and the resealable adhesive of the second end of the top sheet mounting the labels to the liner in production of the labels and prior to application of the labels to packages.

11 Claims, 2 Drawing Sheets

PACKAGE RECLOSURE LABEL AND PACKAGE

BACKGROUND OF THE INVENTION

1. Field of the Invention

This invention relates to a label which is adhered to the exterior of a product bag for holding the open top of the bag reclosed after the bag is opened.

2. Discussion of the Prior Art

As is well-known, it is often desirable to reclose the top of a bag after it has been opened. For example, a bag of coffee, potato chips or other food may be opened and less than all of the entire contents removed. To preserve the contents, the top of the bag is usually folded over on itself one or more times and resealed with a clothes pin, a special purpose package closing clip or clamp, or a resealable adhesive strip. See for example U.S. Pat. Nos. 2,153,310; 3,946,507; 4,622,799; 4,902,141; and 5,366,087.

A need exists for a package reclosure label which can be inexpensively manufactured, easily applied in automated package production operations, does not interfere with distribution or handling of the package prior to consumer purchase, is easy and durable for the consumer to use, does not unduly obscure the package, and provides promotion opportunities.

SUMMARY OF THE INVENTION

The invention provides a package reclosure label having a base sheet and a top sheet adhered at a first end to the base sheet. The top sheet extends over and beyond the opposite second end of the base sheet to its own second end which is provided with a resealable adhesive on its bottom side. The resealable adhesive holds the second end of the top sheet against the package in a ready position prior to reclosing the package and is adherable to a folded-over flap of the package for holding the package reclosed. Since the base sheet is relatively short, it obscures less of the package, but the top sheet is long enough to hold the flap of the package closed in a variety of positions.

In a preferred form, the base sheet has pressure sensitive adhesive on the bottom side thereof for holding the base sheet to the package, when the label is applied to the package, or to a release liner prior to application to a package. On the release liner, the resealable adhesive on the second end of the top sheet also serves to hold the label to the release liner.

In a preferred form, the top sheet is a tear resistant synthetic material, so that it is durable in usage. The base sheet, however, can be made of paper. Also, an area of adhesive is preferably provided between the top and base sheets in a central area between the second end of the base sheet and the first end of the top sheet to hold the central area against the top side of the base sheet in production and when on the package. This prevents snagging of the label in production, in application of the label and in handling of the package, and also provides a neater appearance. The areas in the central area in which adhesive is absent, however, permit easy release of the top sheet from the package and base sheet when the bag is ready to be reclosed. Also, to facilitate release, the zone of resealable adhesive at the second end of the top sheet can be spaced inwardly from the edge of the second end, to create an unadhered tab for grasping.

These and other objects and advantages of a label and package of the invention will be apparent from the detailed description and drawings.

DETAILED DESCRIPTION OF THE PREFERRED EMBODIMENTS

Figure 1:
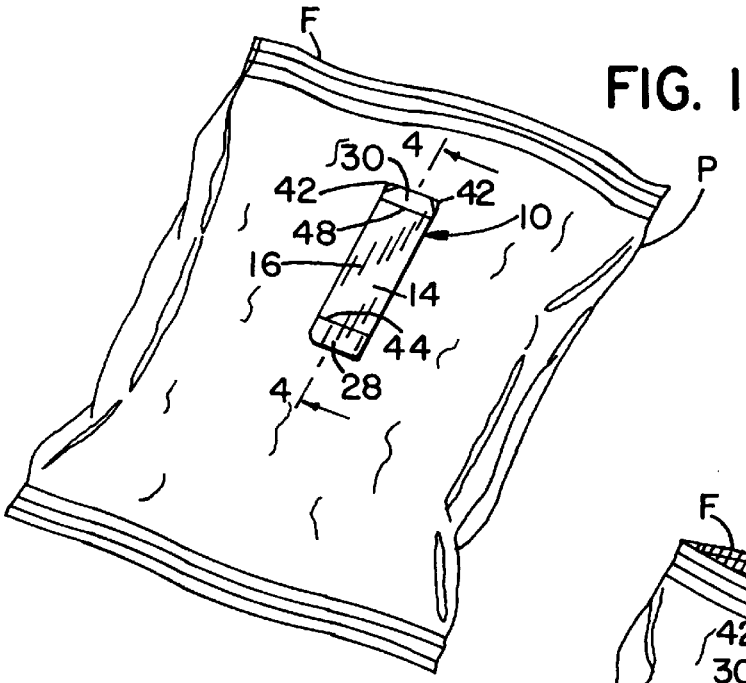
FIG. 1 is a perspective view of an unopened package provided with a reclosure label of the invention.
Figure 2:
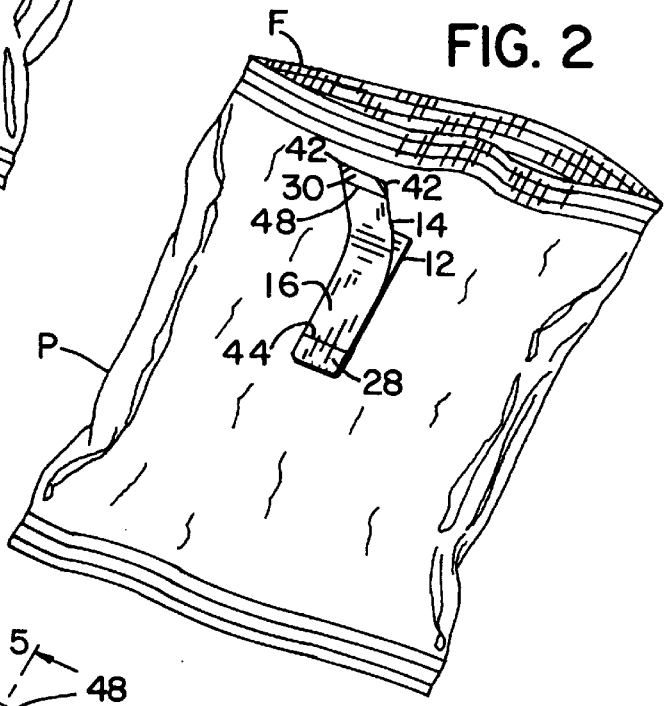
FIG. 2 is a perspective view of the same package opened with the label of FIG. 1 partially opened.
Figure 3:
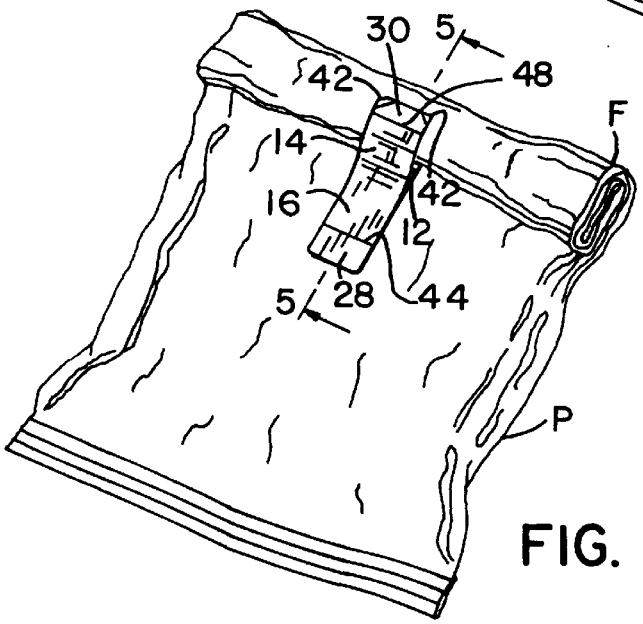
FIG. 3 is a perspective view of the same package reclosed with the label of FIG. 1.
Figure 4:
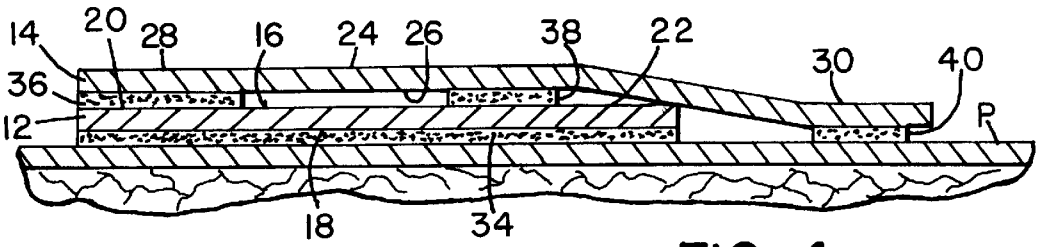
FIG. 4 is a cross-sectional view from the plane of the line 4—4 of FIG. 1, shown with material thicknesses enlarged for purposes of illustration.
Figure 5:
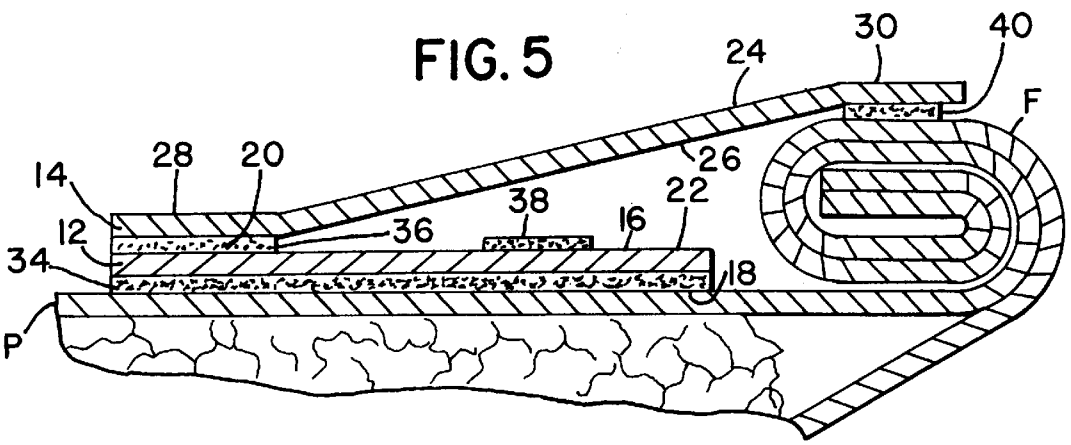
FIG. 5 is a cross-sectional view from the plane of the line 5—5 of FIG. 3, showing the label holding closed the flap of the package, with material thicknesses enlarged for purposes of illustration.

FIG. 1 illustrates an unopened package P which has been applied with a reclosure label 10 of the invention in a body area of the package. As shown in FIGS. 1 and 4, the label 10 is closed in its ready position, in which it is adhered to the body of the package P. After the package P is opened (FIG. 2), part of its contents removed, and it is desired to be reclosed, the top flap F of the package is folded over one or more times toward the label 10, so as to be in a position over the near end of the label 10. The label 10 is then opened up as shown in FIG. 2 (in FIG. 2, the flap F has not yet been folded) and adhered to the folded over flap of the package P as shown in FIGS. 3 and 5, so as to maintain the flap F folded over in the reclosed position.

As shown in FIGS. 2 and 4–6, the label 10 has a base sheet 12 to which is adhered a top sheet 14. The base sheet 12 has a top side 16, a bottom side 18, a first end 20 and a second end 22. The top sheet 14 also has a top side 24, a bottom side 26, a first end 28 and a second end 30.

The top sheet 14 is separate from the base sheet 12 and is preferably made of a material with a relatively high tear resistance, such as 1056 Tyvek™, which is commercially available from E.I. du Pont de Nemours, Wilmington, Del. The base sheet 12, which is adhered over the entire area of its bottom side 18 to the package P with a pressure sensitive adhesive 34, may be made of a lower tear resistance material, such as paper. Preferably, the base label 12 is made from a standard base sheet stock, which is a pressure sensitive paper stock provided on a silicon treated release liner 32 (See FIG. 7). For example, a suitable base sheet stock is Matte Litho on a 50# liner, which is commercially available from Brownbridge Industries, Troy, Ohio, has been found suitable.

The top sheet 14 is the same width as the base sheet 12, and the first ends 20 and 28 are in registration with one another, i.e., their edges are aligned. At the opposite, second ends 22 and 30, the edges are not aligned, but the top sheet 14 extends beyond the second end 22, so the second end 30 is beyond the second end 22. When the label 10 is mounted to the release liner 32, the second end 30 of the top sheet 14 directly overlies and is releasably adhered to the release liner 32, and when the label 10 is in the ready position (FIGS. 1 and 4) on the package P, the second end 30 directly overlies and is releasably adhered to the package P by a layer of adhesive 40, further described below.

As stated above, a pressure sensitive adhesive 34 covers the entire area of the bottom side 18 of the base sheet 12. This adhesive 34 releasably adheres the base sheet 12 to the release liner 32 during production and prior to application of the label 10 to a package P, and tenaciously adheres the base sheet 12 to the package P after the label 10 is applied to the package P, so that in normal usage of the label 10, the base sheet 12 stays adhered to the package P. As stated, the adhesive 34 is included in the Matte Litho stock specified above.

There are three areas 36, 38 and 40 of adhesive, besides the pressure sensitive adhesive 34 on the bottom side 18 of the base sheet 12, which are distributed over the top side 16 of the base sheet and/or bottom side 26 of the top sheet 14. The area 36 permanently adheres the two first ends 20 and 28 together. This adhesive bond is intended to never be broken and therefore a cold glue adhesive may be used. For example, #3535 water base adhesive, which is commercially available from H.B. Fuller Company, St. Paul, Minn., has been found suitable.

The area 38 is in a central region of the top sheet 14, between the areas 36 and 40, and is separated from the areas 36 and 40 by unadhered areas of the top side 16 and bottom side 26 to which no adhesive is applied. The area 38 is a releasable, resealable adhesive, which serves to hold the middle portion of the top sheet 14 against the base sheet 12. It is a low-tack adhesive, and may be permanently applied to either the top side 16 or the bottom side 26. As illustrated in FIG. 5, it is permanently applied to the top side 16, so that the seal between the adhesive 38 and the bottom side 26 is broken when the top sheet 14 is lifted off the base sheet 14, with the area of adhesive 38 left on the top side 16. A suitable adhesive for the adhesive area 38 is #3468, which is a water base adhesive that is commercially available from H.B. Fuller Company, St. Paul, Minn.

The adhesive zone 40 is a releasable, resealable medium or high-tack adhesive which is applied to the bottom side 26 of the top sheet 14 at the second end 30. Hot melt adhesive #2707, which is commercially available from H.B. Fuller Company, St. Paul, Minn., has been found suitable. This adhesive stays adhered to the bottom side 26, and can be repeatedly resealed against the package P or flap F, to repeatedly reclose the package P. The adhesive zone 40 is preferably spaced somewhat inward (toward the first end 28) from the second end 30, so as to create a tab or ears 42 of unadhered top sheet material adjacent to the edge of the second end 30, which can be grasped by a user to easily release the second end 30 from the package P.

Figure 6:
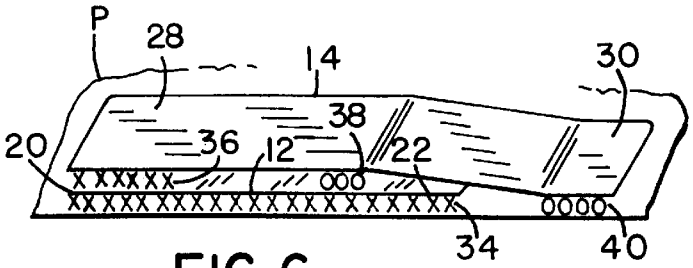
FIG. 6 is a schematic view identifying with X's and O's different bond areas of the label.

In summary, a schematic side view of the label is shown in FIG. 6. X's denote the permanent bond areas 34 and 36, which respectively adhere the base sheet 12 to the package P and the top sheet 14 to the base sheet 12 at the first ends 20 and 28. O's denote the releasable bond areas 38 and 40, which temporarily secure the central area of the top sheet 14 to the base sheet 12 and temporarily secure the second end 30 to the package P or flap F.

The top side 16 of the top sheet 14 may be printed, for example with pictorial instructions on how to reclose the package P with the label 10 (See, for example, FIGS. 1–3). Alternatively, the top side 16 could be printed as a coupon, and the top sheet 14 made releasable from the base sheet 12, for example, by using a releasable adhesive in area 36, or by providing a perforation in the top sheet 14, perhaps in the unadhered area between the adhesive areas 36 and 38.

Lines 44 and 48 are illustrated in FIGS. 1–3 and 7, and also short diagonal lines are illustrated which define the ears 42 at the corners of the end 30. These lines are merely printed lines or lines which define areas of printing which may be desirable and serve no function other than to communicate information. For example, the line 44 is drawn at approximately the inner end of end 28 (and adhesive area 36), to let a user know that the label differs in construction from one side of line 44 to the other, i.e., near the inward side of line 44 the top sheet 14 is not adhered to the base sheet 12 and on the outward side it is. Also, an area of instructions may be printed on the end 28 outward of line 44, for example, "Leave this end attached". At the opposite end 30, outward of line 48, instructions such as "Peel here" may be printed.

Figure 7:
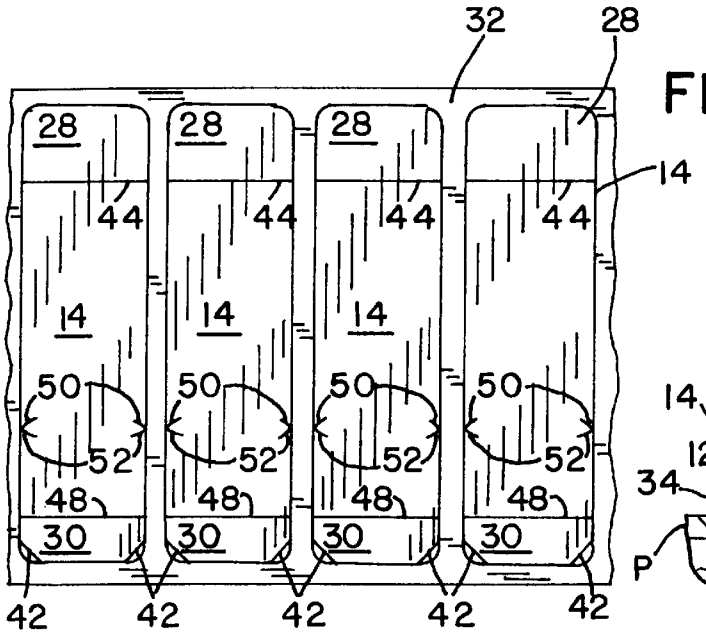
FIG. 7 is a top plan view of multiple labels of the preceding figures carried on a strip of release liner prior to application to the packages to which the labels are adhered.

For production of the labels 10, handling, shipping and application of the labels 10 to packages P, a quantity of the labels 10 would typically be provided on a strip 32 of silicone treated release liner as shown in FIG. 7 and the strip of release liner rolled up. The labels 10 are oriented on the release liner in side-by-side relation with their open edges (their longer side edges, which extend between the first and second ends) perpendicular to the machine direction, i.e., perpendicular to the long edges (i.e., the straight edges of the liner 32 in FIG. 7) of the liner 32.

As stated above, the pressure sensitive adhesive 34 on the underside of the base sheet 12 and the area of resealable adhesive 40 hold each label 10 to the surface of the liner 32 until the labels 10 are applied to packages P. It is noted that a side view (looking at the open edges) of a label 10 mounted on the release liner 50 would be the same as FIG. 4 or FIG. 6, except that the package P would be replaced by the release liner 32.

In production, the base sheet stock is scored down to (but not through) the release liner 32 and the waste side (the right as viewed in FIGS. 4 and 6 and the bottom as viewed in FIG. 7) is stripped from the release liner and discarded, so as to make the base sheet 12 shorter than the top sheet 14. This process is preferably done continuously on an in-line press. In production, a web of the top sheet material may be printed in-line with the printed indicia of serially connected top sheets, including printing on or otherwise applying any varnish, sealant, adhesion agent or other suitable coating (which could also be applied to the base sheet), to facilitate adhesion, release or printing. In the embodiment disclosed, using the materials specified above, no other such coatings are necessary. The adhesives forming the bonds 36, 38 and 40 could be applied in their respective areas of the base 12 or top 14 sheets as continuous stripes.

The continuous top sheet web and the continuous base sheet web (with adhered release liner) are brought together after the adhesives 36, 38 and 40 are applied. All three adhesives are applied to the base sheet and release liner web, with the adhesives 36 and 38 applied to the base sheet in the indicated areas and the hot melt adhesive 40 applied to the release liner in the area so that when the top sheet web is brought together with the base/sheet release liner web, the adhesive 40 transfers to the indicated area of the top sheet 14 web. The adhesives are then at least partially cured, and the final cuts made, down to the release liner 50, which cuts separate the base sheets 12 and top sheets 14 of the individual labels 10 from the adjacent labels 10. The waste matrix left outside of the cuts which separate the labels 10 is stripped from the release liner 50 and discarded.

In the area of the base sheet 12, the label 10 has two sheet material thicknesses (i.e., sheets 12 and 14), and in the area where the top sheet 14 extends beyond the base sheet 12 to the second end 30, the label 10 has only one sheet material thickness (i.e., only sheet 14). As a result, it is preferred to use two different dies to cut out each label 10 from the continuous top and base sheet webs. One die is used for cutting around the three sides of the portion of the top sheet that extends beyond the second end 22 of the base sheet (which is a single thickness) and the other die for cutting around the three sides of the portion of label 10 which has two material thicknesses. So that the cuts made by these two dies are assured of intersecting, the ends of those cuts are turned in, as indicated at 50 and 52 in FIG. 7. Ends 50 are the ends of the cut around the single thickness and ends 52 are the ends of the cut around the double thickness.

Many modifications and variations to the preferred embodiment described will be apparent to those skilled in the art. For example, although specific materials have been identified for the base sheet, top sheet and adhesives used in the preferred embodiment, many other materials could be used to practice the invention. Therefore, the invention should not be limited to the preferred embodiment described but should be defined by the claims which follow.

I claim:

1. A package reclosure label, comprising:

a base sheet having a top surface, a bottom surface, a first end and a second end;

a pressure sensitive adhesive on said bottom surface of said base sheet for adhering said base sheet to said package; and a top sheet having a top side, a bottom side, a first end and a second end, said bottom side of said top sheet being adhered at said first end thereof to said top surface of said first end of said base sheet, and said top sheet extending over said base sheet from said first end to said second end of said top sheet, said second end of said top sheet extending beyond said second end of said base sheet and having a zone of resealable adhesive on the bottom side of said second end of said top sheet, said resealable adhesive being adapted to adhere said second end directly against said package in a ready position prior to reclosing said package and being adherable to a folded-over flap of said package for holding said package reclosed;

wherein said top sheet has a central area between said first and second ends, and an area of adhesive adheres said central area to said top side of said base sheet; and wherein said area of adhesive in said central area is spaced apart from said zone of adhesive on said second end of said top sheet by an area of said bottom side of said top sheet which is unadhered to said base sheet.

2. A package reclosure label as claimed in claim 1, wherein said area of adhesive in said central area is spaced apart from said first end of said top sheet by an area of said bottom side of said top sheet which is unadhered to said base sheet.

3. A package having adhered to it a package reclosure label as claimed in claim 1.

4. A package as claimed in claim 3, wherein said package is sealed at both ends thereof and said pressure sensitive adhesive on said bottom surface of said base sheet adheres said base sheet to a first area of a body portion of said package, said body portion being the portion of said package which is between said sealed ends of said package, and said resealable adhesive on said bottom side of said second end of said top sheet adheres said top sheet to a second area of said body portion, said second area being spaced along said body portion from said first area by approximately the spacing of said resealable adhesive from said pressure sensitive adhesive.

5. A strip of material bearing in side-by-side relation labels as claimed in claim 1, said strip having a top surface of release material, said bottom side of each base label being adhered to said top surface of said strip by a pressure sensitive adhesive and said zone of resealable adhesive at the second end of each top sheet adhering each said second end to said top surface of said strip.

6. A package having adhered to it a package reclosure label, said package reclosure label comprising:

a base sheet having a top surface, a bottom surface, a first end and a second end;

a pressure sensitive adhesive on said bottom surface of said base sheet for adhering said base sheet to said package; and a top sheet having a top side, a bottom side, a first end and a second end, said bottom side of said top sheet being adhered at said first end thereof to said top surface of said first end of said base sheet, and said top sheet extending over said base sheet from said first end to said second end of said top sheet, said second end of said top sheet extending beyond said second end of said base sheet and having a zone of resealable adhesive on the bottom side of said second end of said top sheet, said resealable adhesive being adapted to adhere said second end directly against said package in a ready position prior to reclosing said package and being adherable to a folded-over flap of said package for holding said package reclosed;

wherein said package is opened at an unsealed end thereof and said pressure sensitive adhesive on said bottom surface of said base sheet adheres said base sheet to a first area of a body portion of said package, said body portion being the portion of said package which is between said unsealed end and an opposite sealed end of said package, and said resealable adhesive on said bottom side of said second end of said top sheet adheres said top sheet to a folded-over flap area of said package.

7. A package as claimed in claim 6, wherein said label is in the shape of an elongated strip.

8. A package as claimed in claim 6, wherein said zone of resealable adhesive is spaced toward said first end from an edge of said second end so as to provide an unadhered tab adjacent to said edge.

9. A package as claimed in claim 6, wherein said zone of resealable adhesive on said bottom side of said second end is in an area between said second end of said base sheet and said second end of said top sheet.

10. A package as claimed in claim 6, wherein said top sheet is a tear resistant material.

11. A package as claimed in claim 6, wherein said top sheet has a central area between said first and second ends, and an area of adhesive adheres said central area to said top side of said base sheet.

* * * * *